United States Patent [19]

Brown

[11] Patent Number: 4,457,366

[45] Date of Patent: Jul. 3, 1984

[54] WIPER DEVICE FOR STRIPPING FLUID FROM WELL PIPE

[75] Inventor: William H. Brown, Edmonton, Canada

[73] Assignees: Trevor F. Cuthill; Brian H. Briscoe; Lloyd W. McLaren, all of Edmonton, Canada; part interest to each

[21] Appl. No.: 537,330

[22] Filed: Sep. 30, 1983

Related U.S. Application Data

[63] Continuation-in-part of Ser. No. 427,965, Sep. 29, 1982, abandoned.

[51] Int. Cl.[3] ..... E21B 33/08

[52] U.S. Cl. ..... 166/82; 15/104.04; 15/210 B; 175/84

[58] Field of Search ..... 166/81–84; 175/84; 15/104.04, 210 B, 102

[56] References Cited

U.S. PATENT DOCUMENTS

| | | | |
|---|---|---|---|
| 2,026,036 | 12/1935 | Head | 15/210 B |
| 2,421,564 | 6/1947 | Kleiderlein | 166/82 X |
| 2,718,021 | 9/1955 | Baebel | 15/102 |
| 2,809,012 | 10/1957 | Stevens | 166/82 X |
| 2,937,894 | 5/1960 | Martin et al. | 175/84 X |
| 3,733,641 | 5/1973 | Brown | 166/82 X |

*Primary Examiner*—Stephen J. Novosad
*Assistant Examiner*—Michael Starinsky
*Attorney, Agent, or Firm*—Ernest Peter Johnson

[57] ABSTRACT

A wiper device is provided comprising a container having a central opening through which the well string may pass. A pair of opposed wiper pads disposed in a horizontal attitude are mounted in spaced vertical relationship within the container for longitudinal movement toward each other, to engage the vertical string. A double-acting pneumatic cylinder actuates each pad. Each cylinder is mounted in the plane of the pad, said cylinder being connected at its front end with the rear portion of the wiper pad and being pivotally connected at its rear end with a support member. The front end of the cylinder is thus adapted to rotate in a horizontal plane about its pivot connection, to accommodate transverse movement of the attached wiper pad. The container side walls are spaced from the wiper pad edges to permit such transverse movement to take place. Arrays of anti-friction rollers support each of the pads. The spacing of the walls, pivoting capability of the cylinder in a horizontal plane, and provision of the anti-friction means combine to permit transverse movement of the wiper pads. The head ends of the cylinders are interconnected by a line to enable air, displaced from one cylinder, to move to the other, to permit of longitudinal movement of the pads. The head ends of the cylinders are also connected with a pulsation tank, so that if both cylinders are simultaneously contracted by passage of an enlargement through the pads, there is little change in wiping pressure. Thus the pads can free-float with the well string, while maintaining a substantially constant wiping pressure.

14 Claims, 11 Drawing Figures

WIPER DEVICE FOR STRIPPING FLUID FROM WELL PIPE

This application is a continuation-in-part of application Ser. No. 427,965, filed Sept. 29, 1982 now abandoned.

BACKGROUND OF THE INVENTION (a) Field of the Invention

This invention relates to a wiper device for use in stripping fluid, such as drilling mud, from the outside surface of a well string.

(b) Prior Art

In my U.S. Pat. No. 3,733,641, issued May 22, 1973, which is incorporated herein by reference, there is disclosed a wiper device for stripping and recovering drilling mud or other fluid from the exterior surface of a well string. This wiper device incorporates a combination of components and functions which will now be described in a general way, in connection with a drilling operation.

The device comprises a box-like container. This container is normally mounted in the sub-structure directly beneath the rotary table of the drilling rig. The container has a central opening through which the vertical drilling string may pass. The opening is connected with the flow nipple extending up from the rig blow-out preventer. Drilling mud which is stripped from the string is retained by the container and flows downwardly through the opening into the flow nipple and is returned to the rig mud system.

In the container there is positioned a pair of horizontal wiper pads which close on the drilling string with pressure and strip off the mud. Each wiper pad is a flat member comprising a central wiper block, of rubber or like material, secured between upper and lower steel plates. The steel plates are recessed in the central leading edge section, so that it is only the wiper block which engages the drilling string. Each wiper block is formed with a horsehoe-shaped indentation in its leading edge, for providing encircling engagement with the drilling string. The wiper pads are disposed on opposite sides of the opening, in a vertically staggered arrangement.

Double-acting pneumatic cylinders are mounted on the wiper pads and link them together. The cylinders may be actuated to draw the pads together so that they close on the drilling string passing through the container opening. An air system supplies and exhausts operating air to and from the cylinders.

The side walls of the container are spaced outwardly from the side and end edges of the wiper pads. This, together with the mounting of the cylinders directly on the pads and the use of flexible air hoses, make it possible for the pads to move universally or in all directions in a horizontal plane. Thus they can move with the laterally swaying drilling string as it is being pulled from the well bore. Otherwise stated, the wiper pads are "free floating" with the drilling string.

An accumulator or pulsation tank is connected with the cylinder air supply and exhaust lines. The accumulator tank is included to permit the wiper pads to simultaneously move outwardly (when an enlargement, such as the drill bit, passes through them) while still maintaining a substantially constant closing pressure.

In summary, the assembly is designed to provide wiper pads which are free-floating, to accommodate lateral swaying of the drill string, and the air system is adapted to maintain a substantially constant wiping pressure.

(c) The Need

The prior art wiper device has been usable with the majority of rigs. However, there is a need for a wiper device which is capable of passing very large diameter components. A typical specification for a very large rig requires that a wiper device be capable of opening sufficiently to pass tools having a diameter up to 30 inches.

The prior art device of U.S. Pat. No. 3,733,641 is not amenable to being scaled up to this size. The width and length of the wiper components would be such that its rigidity would not be sufficient. Thicker plate and larger cylinders would be needed, which would affect the thickness of the unit, making it difficult to accommodate within the crowded confines of the sub-structure. The unitary assembly, consisting of the two wiper pads and the cylinders mounted on them, would be very heavy. This weight affects wear of the wiper block's horseshoe-shaped indentation surface. If the pad assembly is very heavy, the vertically travelling, swaying drilling string must bear heavily against the wiper block to cause the assembly to move laterally or longitudinally—this leads to rapid wear of the block. If the wear is at the end of the indentation, it is not a serious problem, as the cylinder will advance the block so that it tightens against the drilling string. But if the wear occurs at the side surfaces of the indentation, then there is no means by which the resultant gap can be remedied, and the wiping performance of the block suffers accordingly. This leads to having to replace the wiper block, which is not easy to do in the prior device, as it requires removal of the entire wiper pad and cylinder assembly for disassembly and insertion of a new block.

There is therefore a need for a new wiper device having minimal vertical thickness, wiper pads which can easily be moved laterally, and wiper pads whose resilient deformable wiper blocks may easily be replaced.

SUMMARY OF THE INVENTION

A wiper device is provided which is similar in most respects to my prior version. However there are changes in the instant version.

Firstly, the wiper pads are each now supported by an array or layer of anti-friction means. Preferably, such means are rollers arranged with their longitudinal axes parallel to the longitudinal direction of movement of the wiper pads. Thus, when moving longitudinally, the wiper pad contacts each roller only along a thin line or "knife edge"; when moving transversely, the rollers rotate with the pad to ease its movement. Thus the heavy pads can be shifted easily in the transverse direction, while the cylinders are available to force them to move in the longitudinal direction.

Secondly, a cylinder is secured at its front end to each wiper pad and is pivotally mounted to the substructure or container for rotation in a horizontal plane. Thus the front end of the cylinder can rotate to left or right to permit the wiper pad to move transversely. Preferably, the cylinder is disposed substantially in the plane of the wiper pad with which it is associated. Thereby minimizing the thickness of the unit. In another preferred feature, the cylinder rod is attached to the rear margin of the wiper pad and the barrel is pivotally attached at its outer end to a support extending from the container.

It is to be noted that, in accordance with the present invention, there are no cylinders mounted on the wiper pads.

As a result of providing this combination of means, the following features characterize the new device:

(1) the wiper pads can easily be moved laterally and the weight to be moved is only that of the single wiper pad (instead of the combined weight of the pads and cylinders)—thus side wear of the wiper blocks is reduced;

(2) the unit is relatively thin in the vertical direction; and (3) The desired free-floating nature of the wiper pads is retained.

In a preferred feature, a fluid supply system for the cylinders is provided which is operative to enable simultaneous contraction of one cylinder and expansion of the other, while wiping pressure is kept constant. This makes it possible for the wiper pads to accommodate movement of the well string in a direction parallel to the longitudinal axis of the container. This capability is achieved by providing a compensation line between the ends of the cylinders, which are pressurized during wiping; air exhausted from the contracting cylinder can be transferred through this compensation line to the expanding cylinder. The system is also operative to enable simultaneous contraction of the cylinders while maintaining the wiping pressure substantially constant. This is achieved by connecting an accumulator tank into the compensation line. If there is simultaneous contraction of the cylinders, the exhausted air may move into the tank with little change of the wiping pressure.

In another preferred feature, the top plate of each wiper pad is hinged or otherwise disengageable, so that it may be removed to permit access to the wiper block through the rotary table. This, of course, has been made possible by removing the cylinders from on top of the pads. As a result, the wiper blocks may now more easily be replaced.

In another preferred aspect, the container is split substantially at its longitudinal mid-point, to provide two container segments. One of the two layers of anti-friction rollers is mounted to and contained within each container segment. One of the two wiper pads is associated with each container segment and contained therein. The wiper device is thus in two halves which can be pulled apart and removed from the rig sub-structure, if this is required. This capability can be of importance, for example, in the case of a well blow-out, when it may be necessary to insert unusually large components down through the rotary table onto the wellhead.

In still another preferred aspect, the container is split, as aforesaid, and a second outer frame is provided around it. This outer frame has a pair of side walls, each of which extend along one longitudinal side wall of the split container and, when its segments are together, extend well beyond its ends. These outer frame side walls each comprise inwardly projecting rack means. Each of the container segments is provided with one or more wheel assemblies mounted on each of its side walls and projecting outwardly therefrom. These wheel assemblies are arranged to run on the adjacent track means. Means, such as cylinder assemblies, are mounted in or on the outer frame side walls and are arranged to bias the container segments between open and closed positions. As a result, the segments and their internals can be shifted to an open position, where there is wide separation in the event unusually large components are to be passed through the device, and a closed or normal operating position.

Broadly stated, the invention is an improvement on a wiper device for stripping fluid from the outer surface of a well string as it emerges from a well bore, said device comprising: a container having an opening for the passage therethrough of a vertical well string, a pair of opposed, vertically spaced, horizontally disposed wiper pads positioned in the container and adapted to be moved longitudinally to engage opposite sides of the well string, a pair of cylinder means for closing said wiper pads onto the well string by moving them longitudinally, the sides of the container being spaced from the wiper pads to permit of transverse movement of said pads in a horizontal plane as the string sways laterally and the pads follow it. The improvement comprises: two vertically spaced layers of anti-friction means mounted to the container and each arranged to support one of the wiper pads, for facilitating universal movement of the pad in a horizontal plane, said cylinder means comprising a pair of cylinders associated with the container, each such cylinder having its inner end connected with one of the wiper pads and being pivotally supported adjacent its outer end so as to permit of rotation of the inner end of said cylinder in a horizontal plane, whereby the associated wiper pad may move laterally to follow the well string, said cylinder being disposed substantially in the same horizontal plane as the wiper pad with which it is associated.

DESCRIPTION OF THE PREFERRED EMBODIMENT

Figure 1:
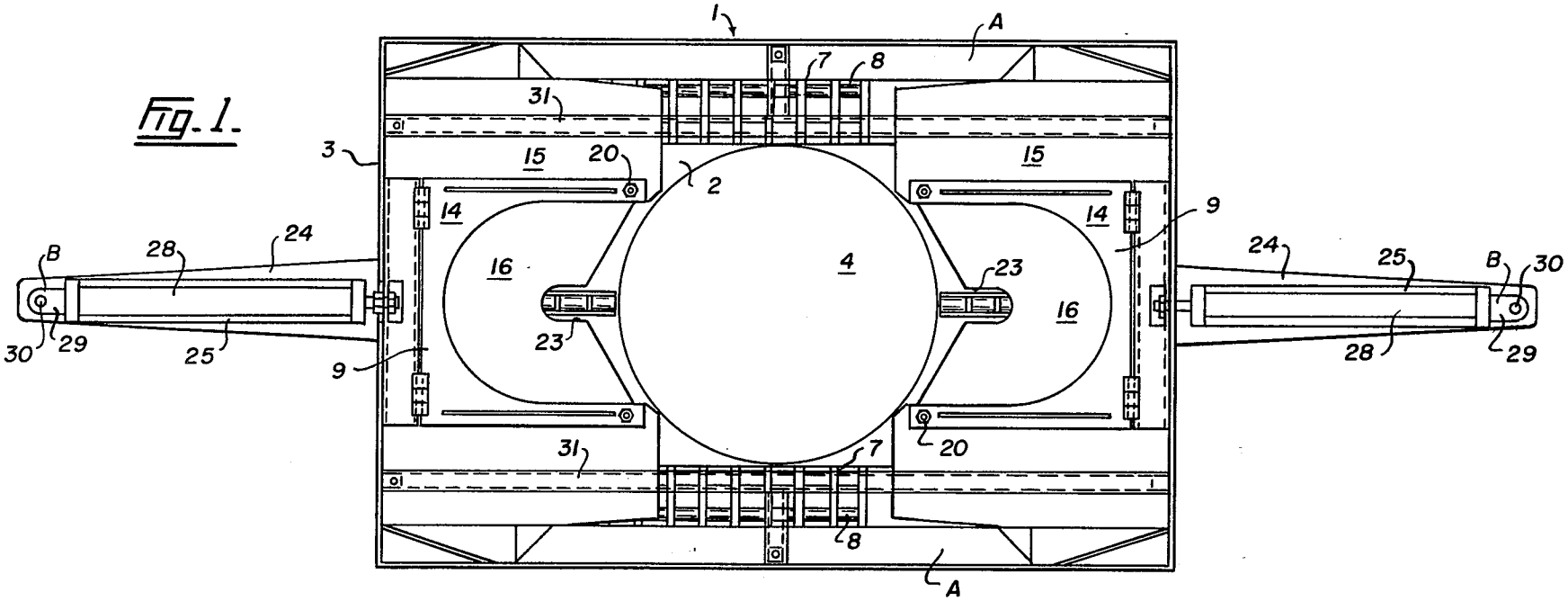
FIG. 1 is a top plan view of the wiper device with the wiper pads in the central, retracted or open position.
Figure 2:
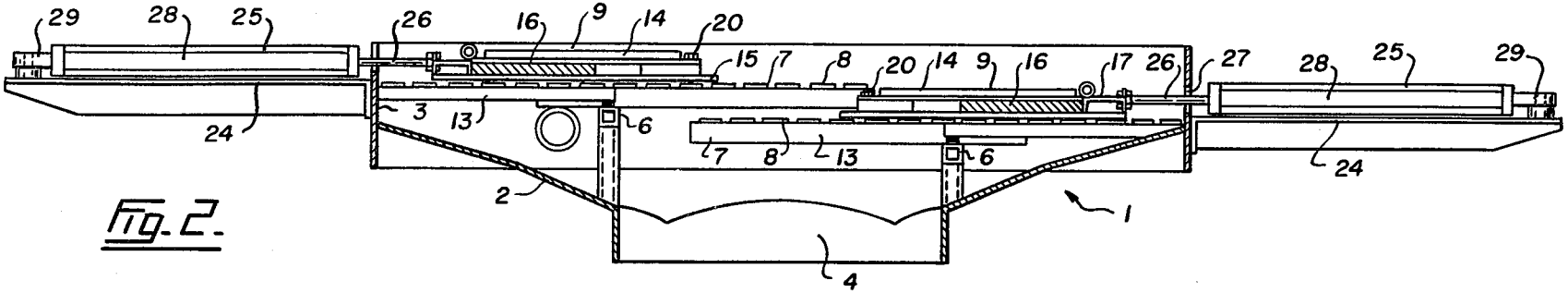
FIG. 2 is a side view, partly in section, taken along the line 1—1 of FIG. 1, with the wiper pads partially closed.

The wiper device comprises a rectangular open-topped container 1 having a conical bottom wall 2 and an upstanding side wall 3. A central opening 4 is formed at the centre of the bottom wall 2; the vertical well string 5 may pass upwardly through this opening. The container 1 is adapted to be mounted to the drilling rig sub-structure (not shown) directly beneath the rotary table. The container functions to support the rest of the assembly and to contain the stripped fluid, which can funnel downwardly through the opening 4 into the rig flow nipple (not shown), for return to the rig mud system.

Mounted on cross-braces 6 within the container 1 are vertically spaced lower and upper layers 7 of rollers 8, for supporting the lower and upper wiper pads 9 respectively. Each layer 7 is made up of a central array 10, extending from one end of the container toward the opening 4, and two more arrays 11, 12, each of which extends along one side of the opening 4. Each array 10, 11, 12 comprises a plurality of rollers 8 mounted in a frame 13, with the longitudinal axes of the rollers being aligned with the longitudinal direction of movement of the wiper pads 9.

Each wiper pad 9 comprises a composite structure involving U-shaped upper and lower steel plates 14, 15 between which is sandwiched a resilient, deformable wiper block 16. The leading edges of the plates 14, 15 are cut back in their central area so that only the wiper block 16 is left to contact the well string 5. The lower plate 15 is wider than the wiper block 16 and upper plate 14; it extends across most of the width of the container 1 but, when the wiper pad is centered in the container, there is a gap or spacing A between each side edge of the lower plate 15 and the side wall of the container 1. A hinge bracket 17 extends along the rear edge of the lower plate 15 and is welded thereto. A threaded bolt 20 and a row of dowels 18 protrude upwardly from each side arm of the lower plate 15. The wiper block 16, having a row of holes 19 formed along each side portion thereof, is constructed so that, when dropped onto the lower plate 15, the bolts 20 and dowels 18 penetrate the holes 19, whereby the wiper block 16 is fixed to the lower plate 15. The upper plate 14 is hinged along its rear edge to the bracket 17. The upper plate 14 also has holes 21 formed in it to correspond with the bolts 20 of the lower plate 15. The upper plate 14 can thus be swung down onto the wiper block 16 and nuts 22 screwed onto the bolts 20 to lock the upper plate 14, wiper block 16, and lower plate 15 together to form a unitary composite member.

Each wiper block 16 is formed with a horseshoe-shaped indentation 23 in its leading edge, for engaging the well string 5.

A cylinder support member 24 extends outwardly from each end wall of the container 1. A cylinder 25 is positioned on each member 24. At its inner end, the rod 26 of each cylinder 25 is secured to the hinge bracket 17 of one of the wiper pads 9. The rod 26 extends through a port 27 in the adjacent container end wall. At each cylinder's outer end, its barrel 28 is pivotally mounted at B to its support member 24 by a lug 29 and pin 30. A wiper pad and its associated cylinder can thus rotate to a limited extent in a horizontal plane about its pivot point B.

The cylinder 25 can alternatively be pivotally mounted to another support, such as a beam of the rig sub-structure.

The wiper pads 9 are each supported by one of the roller layers 7. Thus the wiper pads are vertically spaced and are adapted to close in overlapping fashion to provide closure of the well bore, when the drilling string is out of the well.

Figure 3:
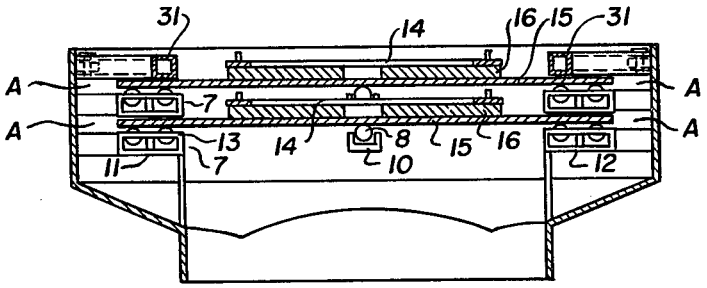
FIG. 3 is an end view in section of the wiper device with the wiper pads in the extended or closed position.
Figure 6:
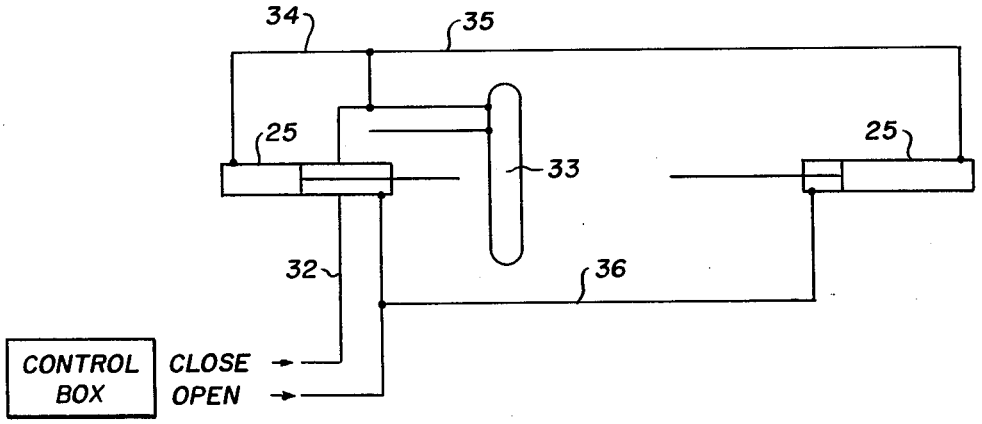
FIG. 6 is a schematic of the pneumatic system.
Figure 4:
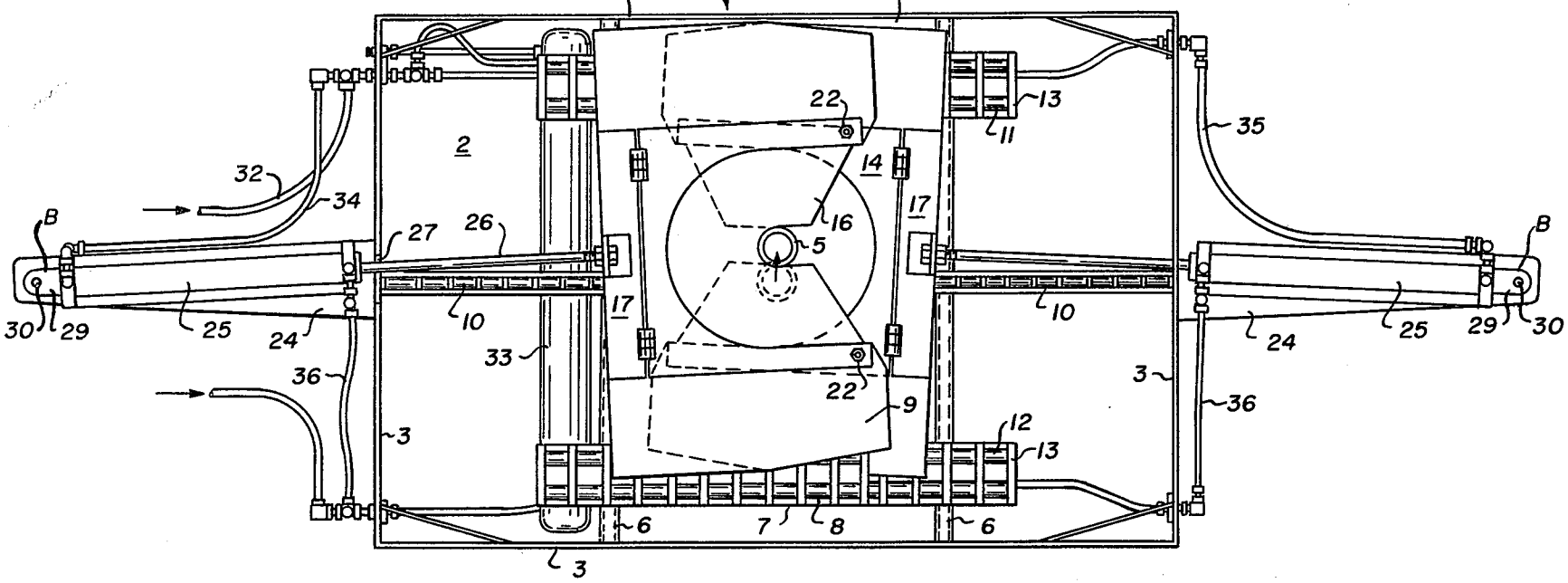
FIG. 4 is a top plan view of the wiper device with the wiper pads in a closed, transversely offset position, and including the details of the pneumatic system.
Figure 5:
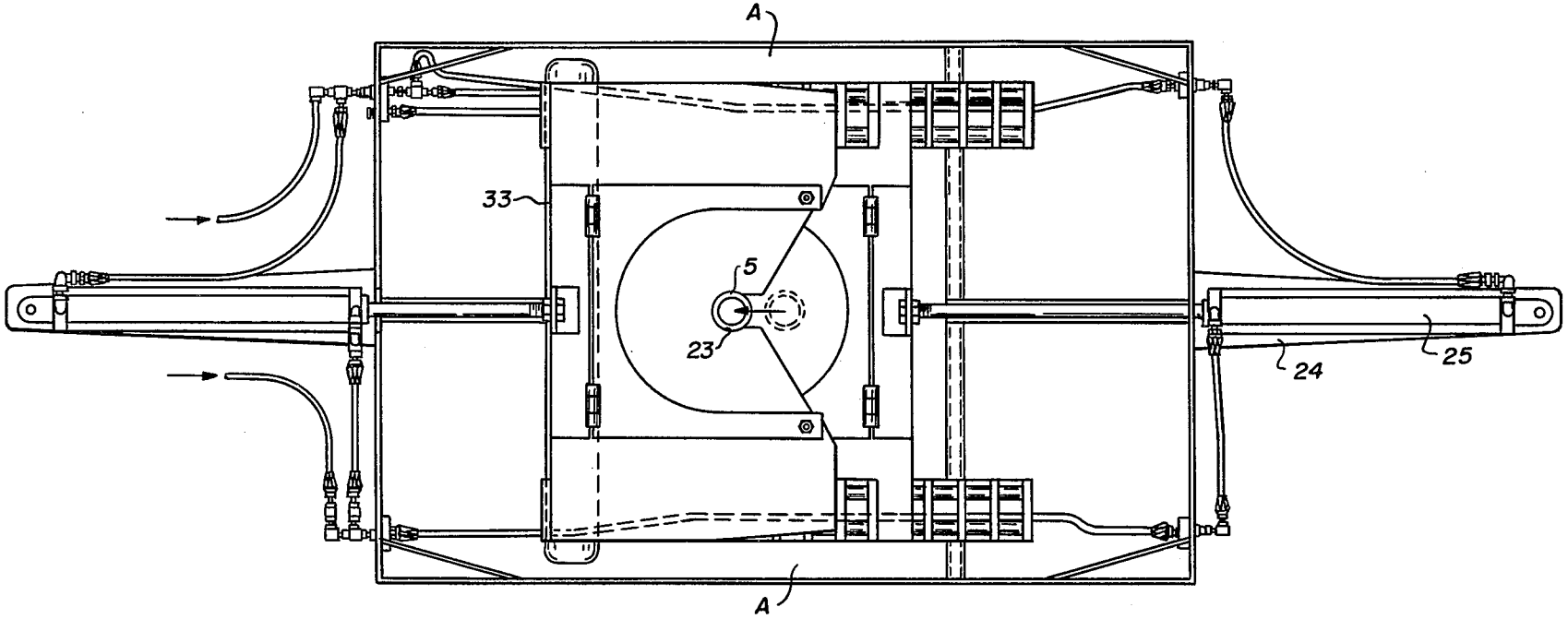
FIG. 5 is a view similar to that of FIG. 4 but with the wiper pads centered in a transverse direction but offset in a longitudinal direction.
Figure 7:
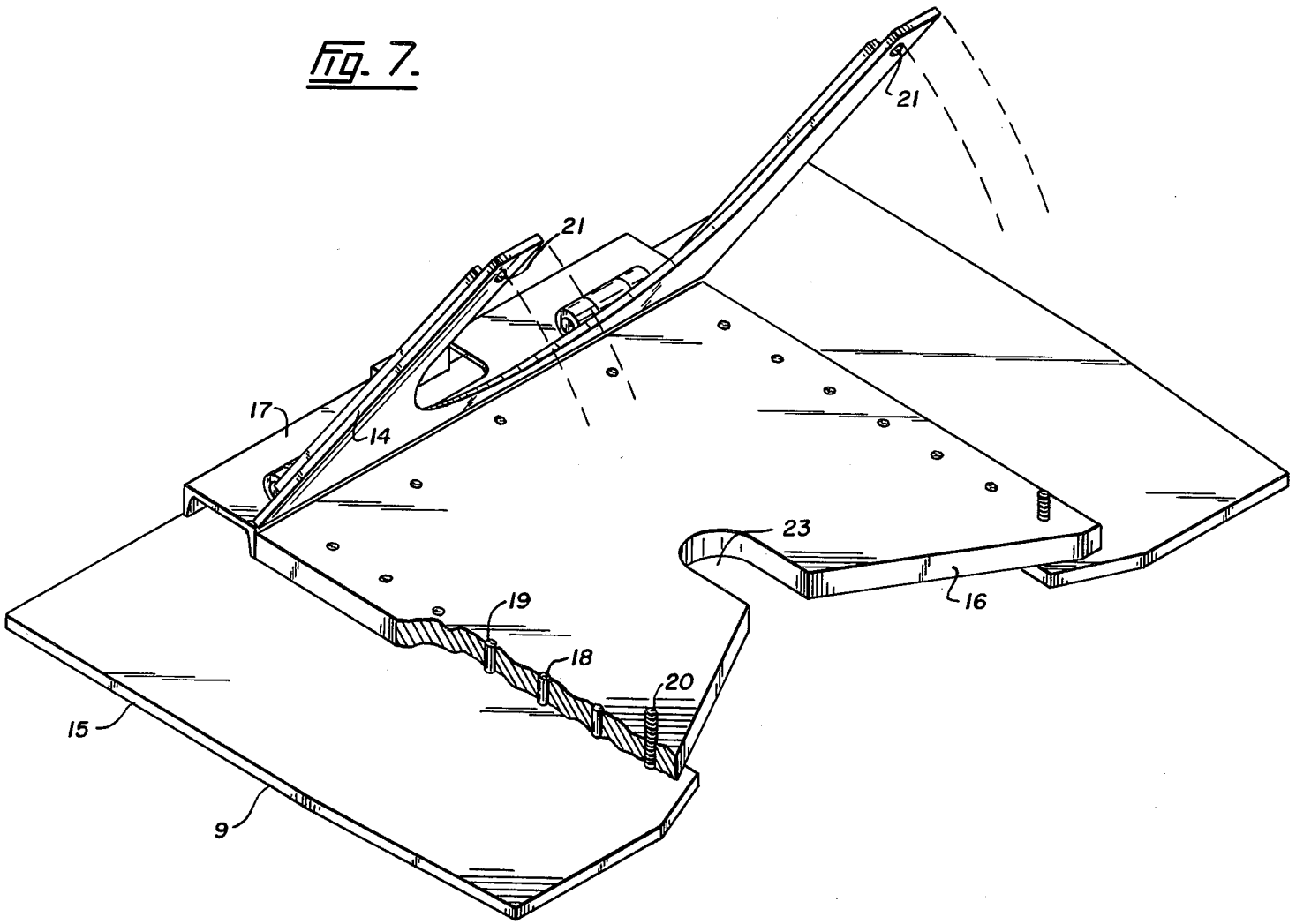
FIG. 7 is a perspective view of a wiper pad alone, showing the dowels and holes used to fix the wiper pad and bottom plate together.

With reference to FIG. 3, the lower plate 15 of the lower wiper pad 9 is trapped between the two fixed sets of roller arrays 11, 12, so that said lower wiper pad 9 is restrained against vertical displacement. A pair of braces 31 extend between the container end walls and they are positioned over the side edges of the lower plate 15 of the upper wiper pad 9, so that said pad is also restrained against vertical displacement.

A fluid supply system is associated with the cylinders 25 for enabling simultaneous contraction of one cylinder means and expansion of the other while maintaining a constant wiping pressure on the well string, whereby the wiper pads and cylinder means may accommodate movement of the well string in a direction longitudinal of the container, and for enabling simultaneous contraction of the pair of cylinders while maintaining said wiping pressure substantially constant, whereby the wiper pads may accommodate the passage of a string enlargement without significant change in wiping pressure.

More particularly, pressurized air, for expanding the wiper pads 9 to close against the drilling string 5, is supplied from a source (not shown) through the line 32 to an accumulator tank 33 mounted to the container 1. The line 32 is also connected through lines 34, 35 with the head ends of the cylinders 25. The rod ends of the two cylinders 25 are connected by the line 36. Thus pressurized air is supplied to the accumulator tank and cylinder head ends, to move the wiper pads 9 longitudinally and press them against the drilling string 5. If an enlargement passes through the pads and forces them apart simultaneously, the air displaced from the head ends is received in the tank 33 with little increase in pressure. If the pads move longitudinally in one direction, the air displaced from one head end is transferred to the other head end through the line 34–35.

From the foregoing, it will be seen that the wiper pads may move universally in a horizontal plane, while maintaining a substantially constant wiping pressure. The structure is relatively thin in a vertical direction, as the cylinders are mounted in the planes of the wiper pads, instead of on top of them. The wiper pads are no longer part of a multi-part unitary assembly (i.e. two pads and four cylinders), and thus the weight of a particular pad resisting the lateral push of the drill pipe is relatively reduced, thereby reducing the extent and rate of wiper block side wear. Also, the rollers greatly improve the ease with which the wiper pads may be laterally displaced. And finally, the removal of the cylinders from on top of the pads, the absence of a top wall on the container, and the hinging of the wiper upper plate combine to permit easy replacement of the wiper blocks through the rotary table.

Turning now to FIGS. 8–11, there is shown an embodiment which is adapted to provide an even larger opening, for the passage therethrough of components of large cross-section, than that of the embodiment of FIGS. 1–7.

This embodiment involves splitting the container 1 in half along the line X and mounting one roller layer 7 and wiper pad 9 in each segment 40. In addition, the container segments 40 are moveably disposed in an outer frame 41, so that they can be rolled between an open position, wherein they are spread apart, and a closed position, wherein they abut and their internal components are in position to operate.

Figure 8:
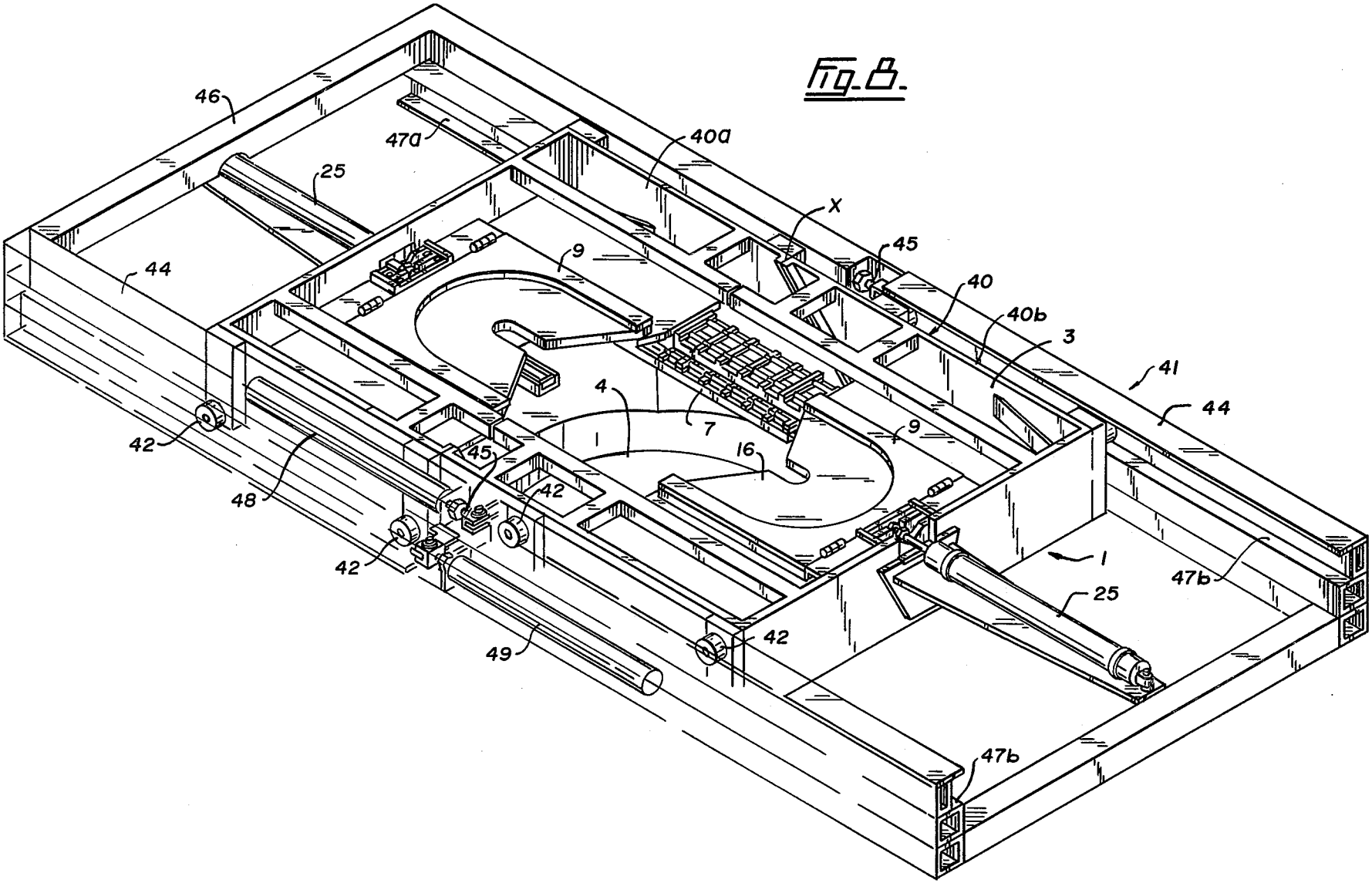
FIG. 8 is a perspective top view, with some internals shown, of a split-container, double-frame version of the device.
Figure 9:
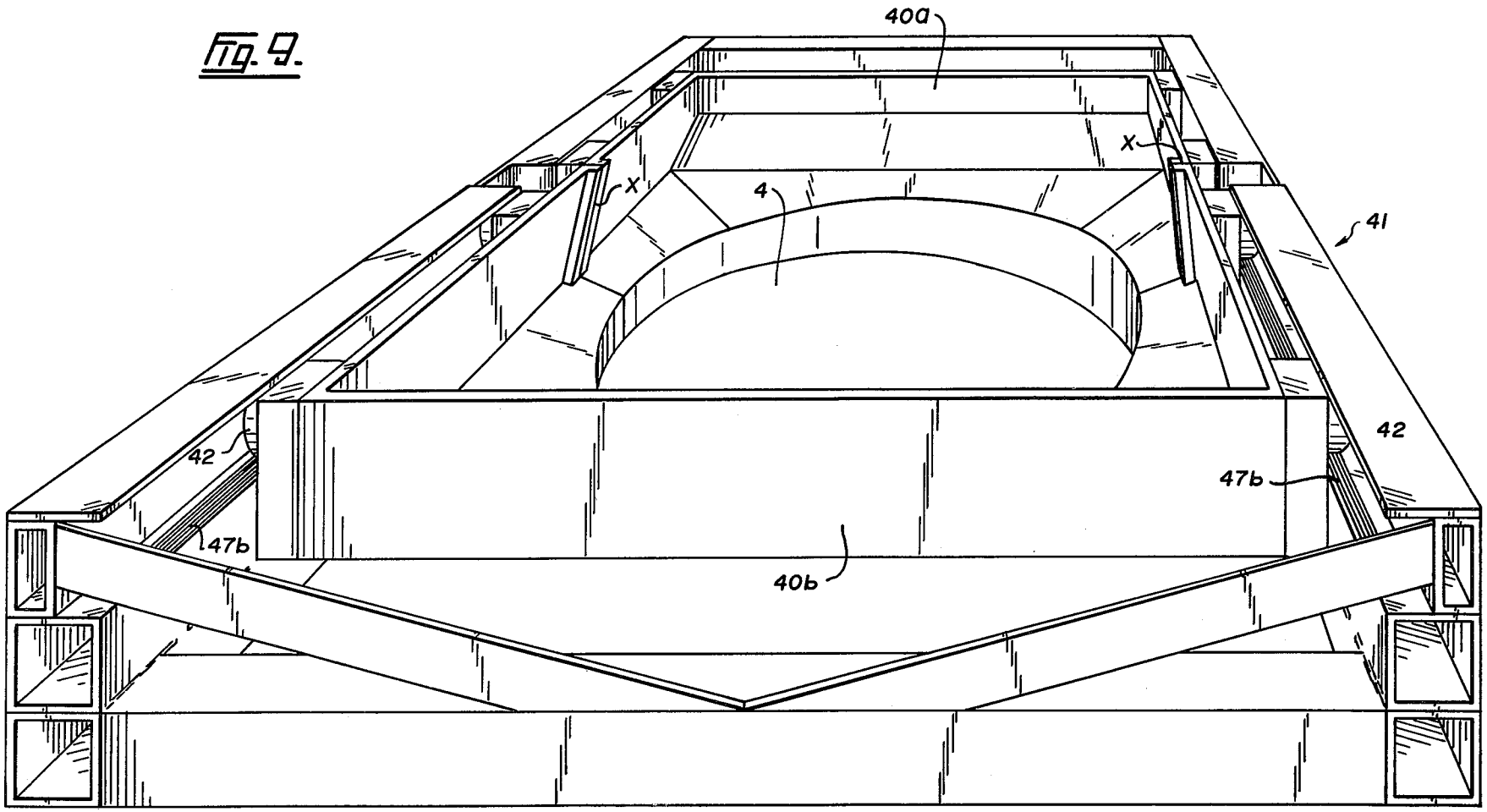
FIG. 9 is a perspective front view showing only the container and outer frame of the device of FIG. 8.
Figure 10:
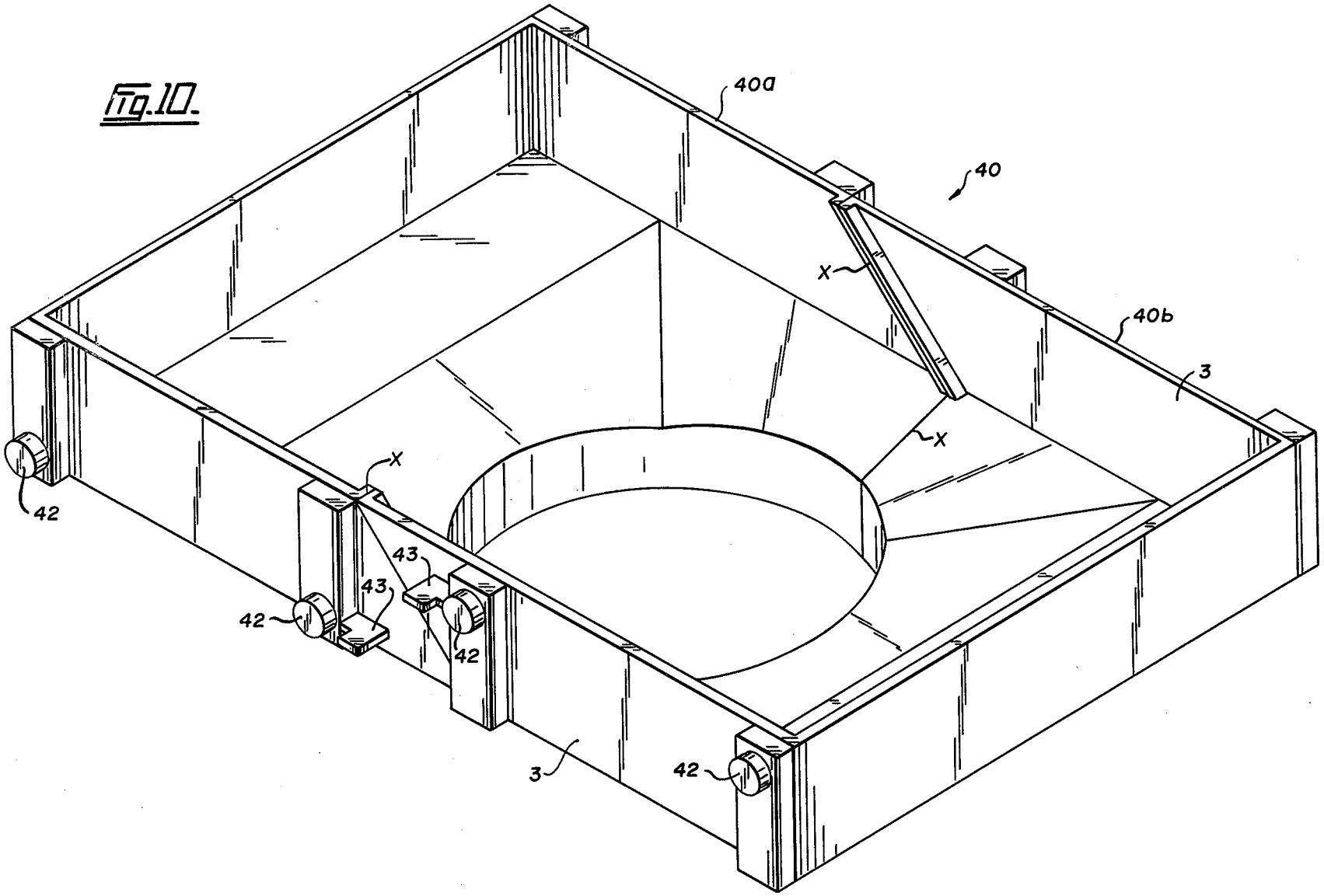
FIG. 10 is a perspective top view, with internals removed, of the split container of the device of FIG. 8.

More particularly, as best shown in FIG. 10, the container 1 is split in two, substantially at its longitudinal mid-point, to provide left and right segments **40*a*, 40*b*. As shown in FIG. 8, the upper roller layer 7 is positioned in the right hand segment 40*b*** and the lower roller layer 7 is positioned in the left hand segment 40*a*. The split line through the container side walls 3 is angularly arranged, so that the roller layers 7 and their associated wiper pads 9 can overlap.

As shown in FIG. 10, the container segment side walls 3 carry a plurality of wheel assemblies 42 and cylinder attachment lugs 43, for purposes described below.

Figure 11:
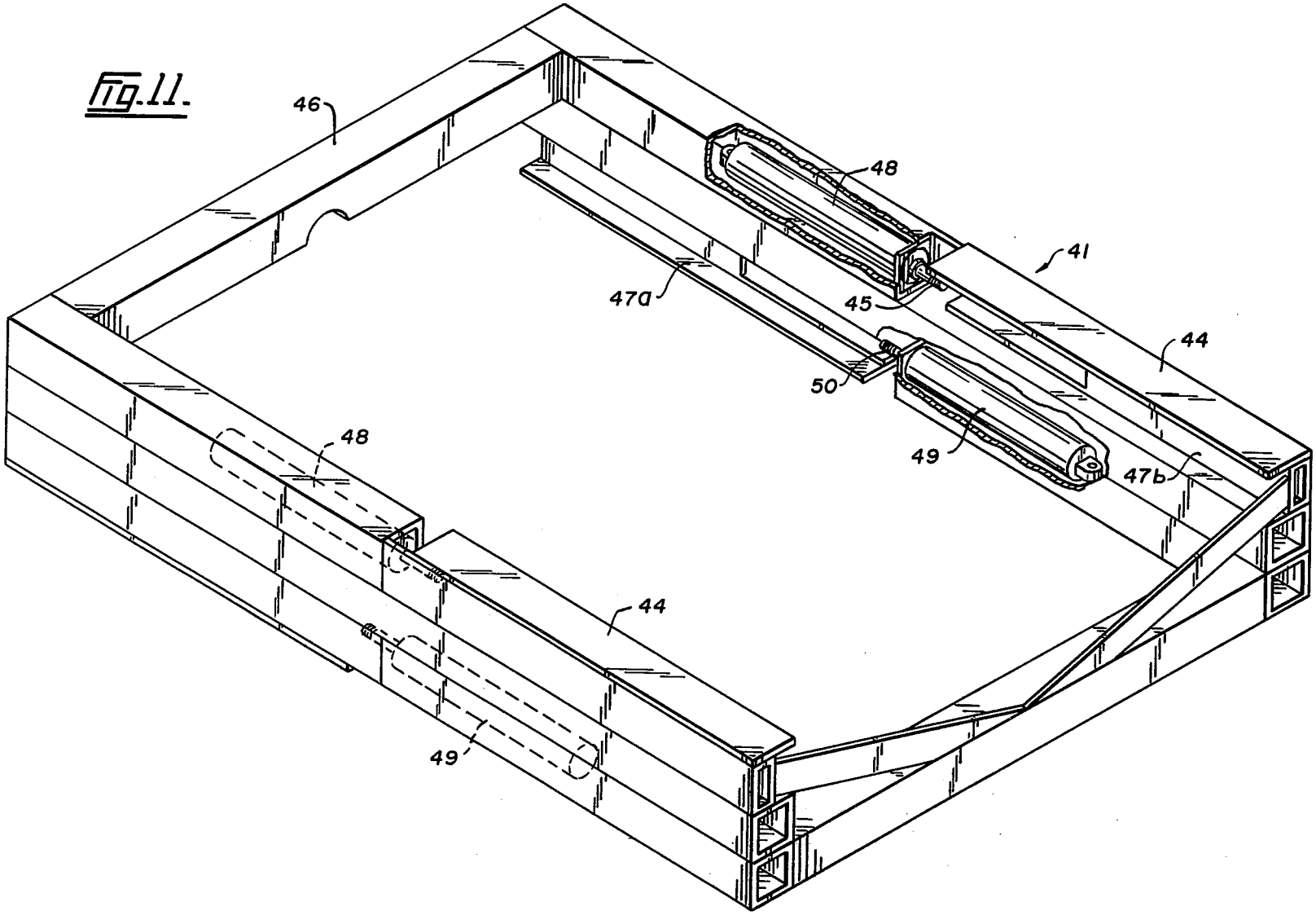
FIG. 11 is a perspective top view of the outer frame of the device of FIG. 8.

Turning now to FIGS. 11 and 8, the outer frame 41 comprises a pair of side walls 44 joined by lateral members 45, 46. The side walls 44 extend along the outside surfaces of the container side walls 3 and are of a length sufficient to extend well beyond the ends of the segments 40.

The left hand end of each outer frame side wall 44 forms an inwardly projecting horizontal track 47*a* long its lower margin. The right end of each side wall 44 forms a similar track 47*b* along its upper margin.

With the container segments 40 in place in the outer frame 41, the wheel assemblies 42 roll along the tracks 47*a*, 47*b* to enable the segments to shift easily between the open and closed positions.

A pair of cylinders 48 are fixed to the left hand end of the outer frame side walls 44 and have their rods 45 attached to the upper lugs 43. Expansion and contraction of these cylinders 48 will cause the right hand container segment 40*b* to shift back and forth between the open and closed positions. Similarly, a pair of cylinders 49 are fixed to the right hand end of the side walls 44 and have their rods 50 attached to the lower lugs 43. Expansion of these cylinders 49 will cause the left hand container segment 40*a* to shift in the same manner.

It is to be understood that the scope of the invention is defined by the claims which now follow and that it is not limited to the specific best mode that has been described.

The embodiments of the invention in which an exclusive property or privilege is claimed are defined as follows:

1. In a wiper device for stripping fluid from the outer surface of a well string as it emerges from a well bore, said device comprising a container having an opening for the passage therethrough of a vertical well string, a pair of opposed, vertically spaced, horizontally disposed wiper pads positioned in the container and adapted to be moved longitudinally to engage opposite sides of the well string, a pair of cylinder means for closing said wiper pads onto the well string by moving them longitudinally, the sides of the container being spaced from the wiper pads to permit of transverse movement of said pads in a horizontal plane as the string sways laterally and the pads follow it, the improvement comprising:

two vertically spaced layers of anti-friction means, mounted to the container and each arranged to support one of the wiper pads, for facilitating universal movement of the pad in a horizontal plane;

said cylinder means comprising a pair of cylinders associated with the container, each such cylinder having its inner end connected with one of the wiper pads and being pivotally supported adjacent its outer end so as to permit of rotation of the inner end of said cylinder in a horizontal plane, whereby the associated wiper pad may move laterally to follow the well string, said cylinder being disposed substantially in the same horizontal plane as the wiper pad with which it is associated.

2. The improvement as set forth in claim 1 comprising:

a fluid supply means, associated with the cylinders, for enabling simultaneous contraction of one cylinder and expansion of the other while maintaining a constant wiping pressure on the well string, whereby the wiper pads and cylinders may accommodate movement of the well string in a direction longitudinal of the container, and may enable simultaneous contraction of the pair of cylinders while maintaining said wiping pressure substantially constant, whereby the wiper pads may accommodate the passage of a string enlargement without significant change in wiping pressure.

3. The improvement as set forth in claim 2 wherein:

the container is open-topped; and each wiper pad comprises upper and lower plates with a resilient deformable wiper block clamped between them, said upper plate being disengageable;

whereby the wiper block is accessible for replacement.

4. The improvement as set forth in claim 3 comprising:

means, associated with the container, for restraining vertical displacement of the wiper pads.

5. The improvement as set forth in claim 1 wherein:

the anti-friction means comprises a plurality of rollers mounted in support means with their longitudinal axes substantially aligned with the longitudinal direction of movement of the wiper pads.

6. The improvement as set forth in claim 2 wherein:

the anti-friction means comprises a plurality of rollers mounted in support means with their longitudinal axes substantially aligned with the longitudinal direction of movement of the wiper pads.

7. The improvement as set forth in claim 4 wherein:

the anti-friction means comprises a plurality of rollers mounted in support means with their longitudinal axes substantially aligned with the longitudinal direction of movement of the wiper pads.

8. In a wiper device for stripping fluid from the outer surface of a well string as it emerges from a well bore, said device comprising a container having an opening for the passage therethrough of a vertical well string, a pair of opposed, vertically spaced, horizontally disposed wiper pads positioned in the container and adapted to be moved longitudinally to engage opposite sides of the well string, cylinder means for closing said wiper pads onto the well string by moving them longitudinally, the sides of the container being spaced from the wiper pads to permit of transverse movement of said pads in a horizontal plane as the string sways laterally and the pads follow it, the improvement comprising:

said container being split, substantially at its longitudinal mid-point, to provide two container segments;

two vertically spaced layers of anti-friction means, one such layer being mounted to each container segment and being contained therein, each such layer being arranged to support one of the wiper pads, for facilitating universal movement of the pad in a horizontal plane;

one wiper pad being associated with each container segment and being contained therein;

said cylinder means comprising a pair of first cylinder, each such first cylinder being associated with one of the container segments, each such first cylinder having its inner end connected with one of the wiper pads and being pivotally supported adjacent its outer end so as to permit of rotation of the inner end of said first cylinder in a horizontal plane, whereby the associated wiper pad may move laterally, to follow the well string, said first cylinder being disposed substantially in the same horizontal plane as the wiper pad with which it is associated.

9. The improvement as set forth in claim 8 comprising:

a pair of outer frame side walls, each extending along one longitudinal side of the container beyond the ends of the container;

each container segment having one or more wheel assemblies mounted on each of its side walls and projecting outwardly therefrom;

each such outer frame side wall forming inwardly projecting track means for supporting the wheel assemblies, whereby each container segment may roll outwardly or inwardly between open and closed positions.

10. The improvement as set forth in claim 9 comprising:

a pair of second cylinders associated with each outer frame side wall and positioned to extend in opposite directions along the length of said outer frame side wall, each such second cylinder being connected with one of the container segments to bias it between the open and closed positions.

11. The improvement as set forth in claim 10 comprising:

a fluid supply means, associated with the cylinder means, for enabling simultaneous contraction of one first cylinder and expansion of the other while maintaining a constant wiping pressure on the well string, whereby the wiper pads and cylinder means may accommodate movement of the well string in a direction longitudinal of the container, and for enabling simultaneous contraction of the pair of first cylinders while maintaining said wiping pressure substantially constant, whereby the wiper pads may accommodate the passage of a string enlargement without significant change in wiping pressure.

12. The improvement as set forth in claim 10 wherein:

the container is open-topped; and each wiper pad comprises upper and lower plates with a resilient deformable wiper block clamped between them, said upper plate being disengageable;

whereby the wiper block is accessible for replacement.

13. The improvement as set forth in claim 12 comprising:

means, associated with the container, for restraining vertical displacement of the wiper pads.

14. The improvement as set forth in claim 10 wherein:

the anti-friction means comprises a plurality of rollers, mounted in support means, having their longitudinal axes substantially aligned with the longitudinal direction of movement of the wiper pads.

* * * * *